US011084555B2

(12) United States Patent
Liu

(10) Patent No.: US 11,084,555 B2
(45) Date of Patent: Aug. 10, 2021

(54) PORTABLE FOLDABLE AQUAPLANE

(71) Applicant: JIANGSU GONGJING GROUP CO., LTD, Jiangsu Province (CN)

(72) Inventor: Pinlun Liu, Jiangsu Province (CN)

(73) Assignee: JIANGSU GONGJING GROUP CO., LTD, Suzhou (CN)

( * ) Notice: Subject to any disclaimer, the term of this patent is extended or adjusted under 35 U.S.C. 154(b) by 0 days.

(21) Appl. No.: 16/613,051

(22) PCT Filed: Dec. 14, 2017

(86) PCT No.: PCT/CN2017/116153
§ 371 (c)(1),
(2) Date: Nov. 12, 2019

(87) PCT Pub. No.: WO2018/205605
PCT Pub. Date: Nov. 15, 2018

(65) Prior Publication Data

US 2020/0198730 A1 Jun. 25, 2020

(30) Foreign Application Priority Data

May 12, 2017 (CN) ..... 201710332075.3

(51) Int. Cl.
*B63B 1/20* (2006.01)
*B63B 1/22* (2006.01)

(52) U.S. Cl.
CPC . *B63B 1/22* (2013.01); *B63B 1/20* (2013.01)

(58) Field of Classification Search
CPC .. B63B 1/22; B63B 1/20; B63B 32/20; B63B 32/30; B63B 32/60; B63B 2001/209;
(Continued)

(56) References Cited

U.S. PATENT DOCUMENTS 2,865,032 A 12/1958 Moody
2,958,875 A 11/1960 McClain
(Continued)

FOREIGN PATENT DOCUMENTS

CN 201189950 2/2009
CN 101468716 7/2009
(Continued)

OTHER PUBLICATIONS

First Chinese Office Action and Search report, issued in the corresponding Chinese patent application No. 201710332075.3, dated Sep. 2, 2019, 16 pages (including machine translation).
(Continued)

*Primary Examiner* — Anthony D Wiest
(74) *Attorney, Agent, or Firm* — Hamre, Schumann, Mueller & Larson, P.C.

(57) ABSTRACT

Provided is a portable foldable aquaplane, comprising a buoyancy device (9), a handle (2), a pedal board (3) and a seat cushion (5), wherein the buoyancy device (9) comprises a head buoyancy component (1) and a body buoyancy component (13); the head buoyancy component (1) is connected to a front end of the body buoyancy component (13) in a foldable manner; the handle (2) is connected to the head buoyancy component (1) via a first telescopic rod (14); and the seat cushion (5) is connected to the body buoyancy component (13) via a second telescopic rod (15). By adjusting the height of the handle (2) and of the seat cushion (5), the aquaplane is not only capable of satisfying the requirements of riding on water in a standing state, but is also capable of satisfying the requirements of riding on water in a sitting state. The foldable structure of the aquaplane makes it easy to carry and store, and same can also provide sports and entertainment for both individuals and multi-players at the same time by means of a connection hook.

8 Claims, 5 Drawing Sheets

(58) Field of Classification Search
CPC ..... B63B 34/10; B63B 2007/003; B63B 7/02; B63B 34/54; B63H 1/36; B63H 16/18
USPC ..... 114/55.5, 55.52, 55.54, 55.55, 55.56, 114/55.57
See application file for complete search history.

(56) References Cited

U.S. PATENT DOCUMENTS

| | | | | |
|---|---|---|---|---|
| 5,374,206 | A * | 12/1994 | Gregory | B63H 16/14 440/27 |
| 5,540,604 | A * | 7/1996 | Dayton | B63H 25/00 114/283 |
| 5,626,501 | A | 5/1997 | He | |
| 9,174,714 | B2 * | 11/2015 | Kachkovsky | B63B 1/12 |
| 2002/0151232 | A1 | 10/2002 | Van Gelder | |
| 2010/0288174 | A1 | 11/2010 | Conti et al. | |
| 2014/0154935 | A1 | 6/2014 | Lee | |
| 2014/0370767 | A1 * | 12/2014 | Kachkovsky | B63B 1/12 440/27 |

FOREIGN PATENT DOCUMENTS

| | | |
|---|---|---|
| CN | 102060089 | 5/2011 |
| CN | 102167142 | 8/2011 |
| CN | 104309777 | 1/2015 |
| CN | 204775891 | 11/2015 |
| CN | 105691562 | 6/2016 |
| CN | 205675194 U | 11/2016 |
| CN | 206087218 | 4/2017 |
| DE | 846660 | 8/1952 |
| KR | 20130071867 | 7/2013 |
| WO | 02/102658 | 12/2002 |

OTHER PUBLICATIONS

Second Chinese Office Action and Search report, issued in the corresponding Chinese patent application No. 201710332075.3, dated Jun. 3, 2020, 15 pages (including machine translation).
International Search Report issued in International Application No. PCT/CN2017/116153, dated Mar. 14, 2018, 6 pages with translation.
Extended European Search Report issued for European Patent Application No. 17909462.8, dated Feb. 2, 2021, 34 pages.

* cited by examiner

PORTABLE FOLDABLE AQUAPLANE

TECHNICAL FIELD

The present disclosure relates to the field of water appliance, and in particular to a portable foldable aquaplane.

BACKGROUND ART

At present, with the continuous development of the tourism, people are more and more keen to go to scenic seaside and lakeside for entertainment or vacation, and the water entertainment or sports projects are becoming increasingly abundant, one of which is the water skiing. The water skiing is usually carried out by a person standing on an aquaplane, which is connected with a boat by a pull handle and a tow rope and towed by the boat to move.

The current aquaplane is usually large in size and difficult to carry, and can only be operated by a single person standing thereon, so that the aquaplane is highly professional and difficult to be used by the general public for entertainment.

SUMMARY OF THE INVENTION

The technical problem to be solved by the present disclosure is to provide a portable aquaplane which has a simple structure and a high safety. The aquaplane is of a foldable structure so as to be folded when being stored or carried, thereby being convenient to be carried. In addition, the aquaplane can be folded by referring to the folding mode of the existing folding bicycle, and the use is convenient.

In order to solve the above problem, the present disclosure provides the following technical solution: a portable foldable aquaplane comprising a buoyancy device, a handle, pedals and a seat cushion; wherein the buoyancy device comprises a head buoyancy component and a body buoyancy component; the head buoyancy component comprises a first head buoyancy member and a second head buoyancy member which are swingably connected with each other; the second head buoyancy member is foldably connected with a front end of the body buoyancy component; the handle is connected with the first head buoyancy member through a first telescopic rod; and the seat cushion is connected with the body buoyancy component through a second telescopic rod.

In addition, the present disclosure further proposes the following subsidiary technical solutions:

A lower side of the second head buoyancy member is connected with a lower side of the body buoyancy component through a first hinge, and an upper side of the second head buoyancy member is connected with an upper side of the body buoyancy component through a first bolt.

The first head buoyancy member and the second head buoyancy member are connected with each other through a second hinge.

Two sides of the body buoyancy component are symmetrically connected with side buoyancy members.

The foot pedal is mounted on the side buoyancy member.

The foot pedal is shaped to fit with a foot shape and is recessed into the side buoyancy member.

The buoyancy device is made of a solid buoyancy material.

A first hook is disposed in front of the first head buoyancy member, and a second hook is disposed behind the body buoyancy component.

The present disclosure provides a portable foldable aquaplane, which has the following advantages over the prior art:

1. The aquaplane is connected in multiple places by folding, while the handle, the seat cushion and the aquaplane are connected by telescopic rods, so as to facilitate the storage and carrying by folding and compressing.

2. The heights of the seat cushion and the handle can be adjusted for standing skiing or sitting skiing.

3. Ropes, connecting rods and the like can be adopted for connection with the hooks of the water skiing board, so that multiple persons can enjoy water skiing at the same time.

In which,

1: head buoyancy component; 1*c*: first head buoyancy member; 1*d*: second head buoyancy member; 2: handle; 3: foot pedal board; 4: rear fixing bracket assembly; 4*a*: first rear fixing bracket; 4*b*: second rear fixing bracket; 5: seat cushion; 6: tail fin; 7: front fin; 8: water stirring sheet; 9: buoyancy device; 11: small fin; 13: body buoyancy component; 14: first telescopic rod; 15: second telescopic rod; 16: first hook; 17: second hook; 18: tail buoyancy part; 20: motor; 21: swing wheel; 22: fishtail part; 23: fixing ring; 24: connecting rod; 1*a*: short side; 1*b*: long side; 25: first bolt; 26: first hinge; 27: side buoyant member; 28: second hinge; 31: rear fin; 32: waterproof container; 33: propeller.

DETAILED DESCRIPTION OF THE PREFERRED EMBODIMENTS

The technical solutions of the present disclosure are further described in detail as follows in conjunction with the preferred embodiments and the drawings.

Embodiment 1

Figure 1:
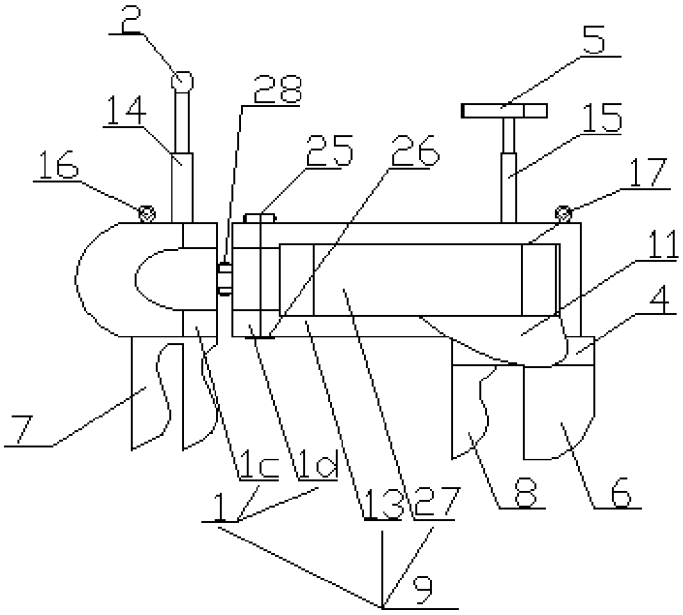
FIG. 1 is a schematic plane-structure diagram of an aquaplane according to Embodiment 1 of the present disclosure.
Figure 2:
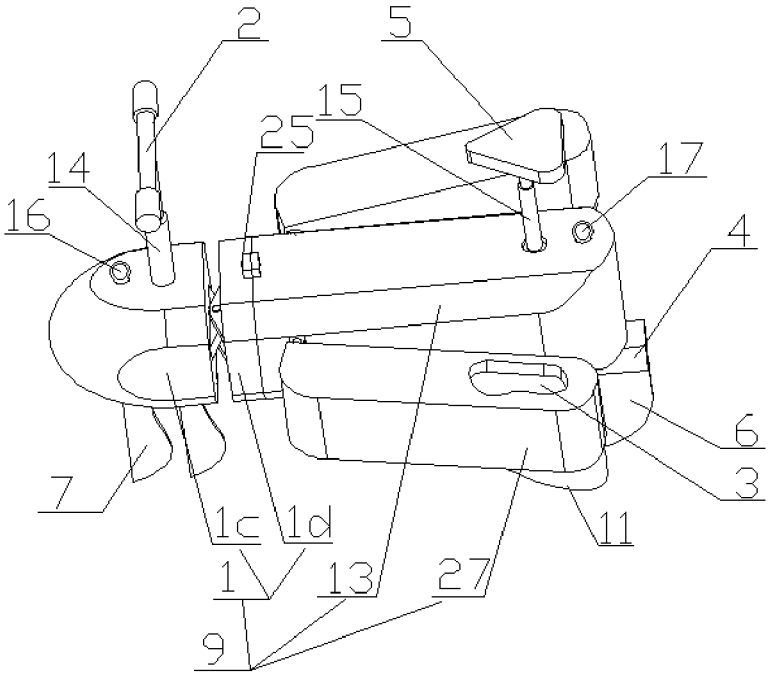
FIG. 2 is a schematic structure diagram of an aquaplane according to Embodiment 1 of the present disclosure.

As illustrated in FIGS. 1 and 2, the aquaplane comprises a buoyancy device 9, a handle 2, foot pedals 3, and a seat cushion 5. The buoyancy device 9 is composed of a head buoyancy component 1 and a body buoyancy component 13; the head buoyancy component 1 comprises a first head buoyancy member 1*c* and a second head buoyancy member 1*d* which are connected through a second hinge 28 to rotate relative to each other; a lower side of the second head buoyancy member 1*d* is connected with a lower side of the body buoyancy component 13 through a first hinge 26, and an upper side of the second head buoyancy member 1*d* is connected with an upper side of the body buoyancy component 13 through a first bolt 25; in use, the first bolt 25 is tightly screwed for fastening each other, and when folding is needed, the bolt can be loosened; side buoyant members 27 are symmetrically connected with two sides of the body buoyant part 13; the side buoyant member 27 has one end connected with a front end of the body buoyant member 13 through a hinge, and is rotatable around a vertical axis within an angle; and the buoyancy device 9 is preferably made of a solid buoyancy material.

A bearing (not illustrated) is provided in the body buoyancy component 13; a telescopic rod 15 connected with the seat cushion 5 is supported by the bearing and connected with a rear fixing bracket assembly 4 through the bearing; a tail fin 6 is foldably connected below the rear fixing bracket assembly 4; the tail fin 6 is preferably a structure with one side hinged with the rear fixing bracket assembly 4 and the other side connected by bolts. The shape of the tail fin 6 is preferably an upright fan-shaped fishtail. In order to further enhance the water-stirring effect, a water stirring sheet 8 in a vertical upright blade shape is connected below the rear fixing bracket assembly 4. By twisting the hip, a person can drive the rear fixing bracket assembly 4 and the tail fin 6 connected therewith to rotate and stir water.

The handle 2 is connected with the first head buoyancy member 1*c* through a first telescopic rod 14; and a second telescopic rod 15 connected with the seat cushion 5 is supported by the bearing in the body buoyancy component 13. The structure of the telescopic rod is similar to that of a folding bicycle, and a person can choose a sitting posture or a standing posture by adjusting heights of the handle and the seat cushion.

The foot pedal 3 is disposed on and recessed into the side buoyancy member 27, with a shape conforming to a foot shape of a person, so as to prevent slipping.

A front fin 7 is connected below and foldable relative to the head buoyancy component 1. The front fin has a vertical upright blade shape, which is formed by arranging two blade parts back and forth to improve its guiding ability and water-stirring effect. Of course, it is within the scope of this patent to use one or more blades.

In order to better improve the water-stirring effect, a small fin 11 having a vertical upright blade shape is further connected below the side buoyancy member 27.

A first hook 16 is disposed in front of the first head buoyancy member 1*c*, and a second hook 17 is disposed behind the body buoyancy component 13. A plurality of aquaplanes may be connected through ropes or connecting rods and the like, so that a plurality of persons can ride on water at the same time, and the interest is increased.

In use, a person steps his feet into the foot pedals 3, and drives the side buoyancy device 27 to swing back and forth in a fan-shaped range by opening and retracting his legs, and the small fin 11 below the side buoyancy device 27 will stir the water flow to generate a propelling force. The principle is similar to a splayed three-wheel scooter played by a child. At the same time, a person can rotate the handle 2 back and forth to drive the front fin 7 below to stir water, and twist his hip to drive the tail fin 6 behind the rear fixing bracket assembly 4 and the aquaplane 8 to stir water to generate a greater propelling force. In order for braking, a person may spread apart the two feet to align the left and right sides buoyancy devices 27, which can increase the water resistance of the aquaplane and achieve a braking effect.

Embodiment 2

Figure 3:
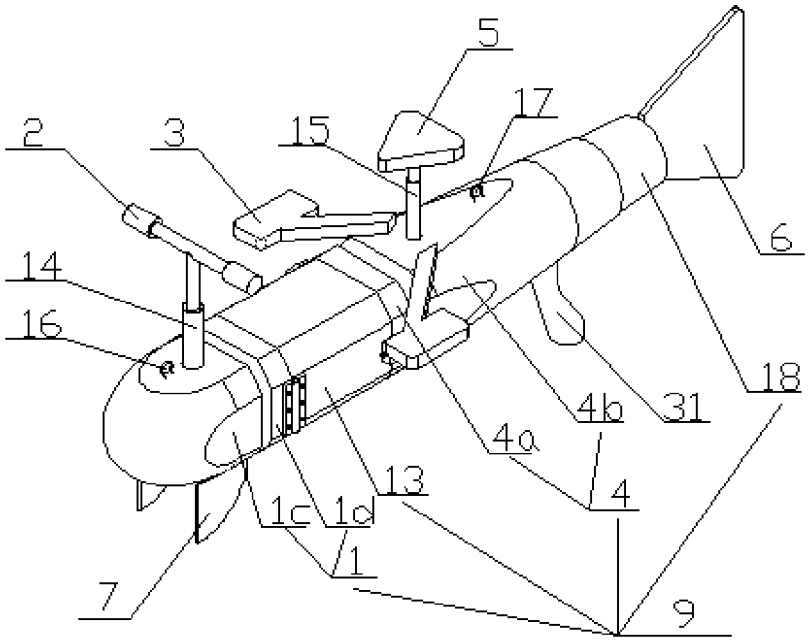
FIG. 3 is a schematic structure diagram of an aquaplane according to Embodiment 2 of the present disclosure.

As illustrated in FIG. 3, the aquaplane comprises a buoyancy device 9, a handle 2, foot pedals 3 and a seat cushion 5.

In which, the buoyancy device 9 is composed of a head buoyancy component 1, a body buoyancy component 13, a rear fixing bracket assembly 4 and a tail buoyancy part 18; the buoyancy device 9 is made of a solid buoyancy material.

The head buoyant part 1 is connected with a front of the body buoyant part 13 and comprises a first head buoyant member 1*c* and a second head buoyant member 1*d*. The first head buoyancy member 1*c* is in swingable hinge connection with the second head buoyancy member 1*d*, and the second head buoyancy member 1*d* is in foldable connection with the front of the body buoyancy component 13, adopting a structure in which one side is in hinge connection and the other side is in bolt connection.

The rear fixing bracket assembly 4 comprises a first rear fixing bracket 4*a* and a second rear fixing bracket 4*b*, wherein the first rear fixing bracket 4*a* is in foldable connection with the body buoyancy component 13, with one side in hinge connection and the other side in bolt connection. The first rear fixing bracket 4*a* and the second rear fixing bracket 4*b* are in hinge connection, and swingable relative to each other around a vertical axis within an angle.

The handle 2 is connected with the first head buoyancy member 1*c* through a telescopic rod 14; the seat cushion 5 is connected with the second rear fixing bracket 4*b* through a telescopic rod 15; the structure of the telescopic rod is similar to that of a folding bicycle, and a person can choose a sitting posture or a standing posture by adjusting heights of the handle 2 and the seat cushion 5. A tail fin 6 is connected behind the tail buoyancy part 18, with one side in hinge connection and the other side in bolt connection, thereby achieving a foldable effect; and the shape of the tail fin 6 is an upright fan-shaped fishtail.

The tail buoyancy part 18 adopts a telescopic structure, which is composed of a plurality of hollow drums from large to small, wherein a smaller drum can be retracted into a larger drum. The tail buoyancy part 18 can be pulled out when in use and compressed when not in use.

The foot pedals 3 are symmetrically fixed to the second rear fixing bracket 4*b* through a connecting rod that can increase the moment arm when a person steps on the foot pedal, thereby saving the physical strength of the person.

Front fins 7 are disposed below the first head buoyancy member 1*c* and symmetrically arranged on the left and right sides of the head buoyancy component 1, so that the front fins 7 can conveniently guide the aquaplane.

Rear fins 31 are disposed below the second rear fixing bracket 4*b* and symmetrically arranged on the left and right sides below the rear fixing bracket assembly 4. The rear fins 31 can stir water when the second rear fixing bracket 4*b* swings, thereby providing a propelling force.

In use, a person applies a leftward or rightward force to the second rear fixing bracket 4*b* by stepping on the foot pedal, and since the second rear fixing bracket 4*b* and the first rear fixing bracket 4*a* are rotatable relative to each other through a hinge, the second rear fixing bracket 4*b* will swing left and right, thereby causing the tail buoyancy part 18 and the tail fin 6 to swing and stir water to generate a forward driving force. At the same time, a person can also rotate the handle 2 left and right to drive the first head buoyancy member 1*c* to swing left and right, thereby driving the front fin 7 connected below to stir water to provide a part of propelling force. A first hook 16 is disposed in front of the first head buoyancy member 1*c*, and a second hook 17 is disposed behind the second rear fixing bracket 4*b*. A plurality of aquaplanes can be connected through ropes or connecting rods and the like, so that a plurality of persons can ride on water at the same time, and the interest is increased.

Embodiment 3

Figure 4:
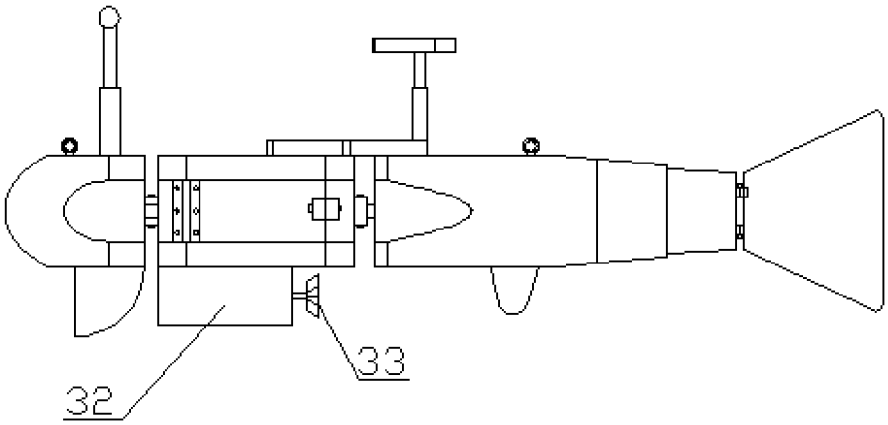
FIG. 4 is a schematic structure diagram of an aquaplane according to Embodiment 3 of the present disclosure.

As illustrated in FIG. 4, an electric propulsion device comprising a waterproof container 32, a motor (not illustrated), a battery (not illustrated), a control lever (not illustrated) and a propeller 33 is mounted below the aquaplane described in Embodiment 2. The motor and the battery are mounted in the waterproof container 32, the control lever is mounted on the handle 2, and the propeller 33 is connected with a motor shaft. The battery supplies power for the motor, the control lever controls the start and stop of the motor, and the motor drives the propeller 33 to rotate, thereby generating a forward driving force. The device can reduce the burden of manual riding on water and improve the speed and comfort.

Embodiment 4

Figure 5:
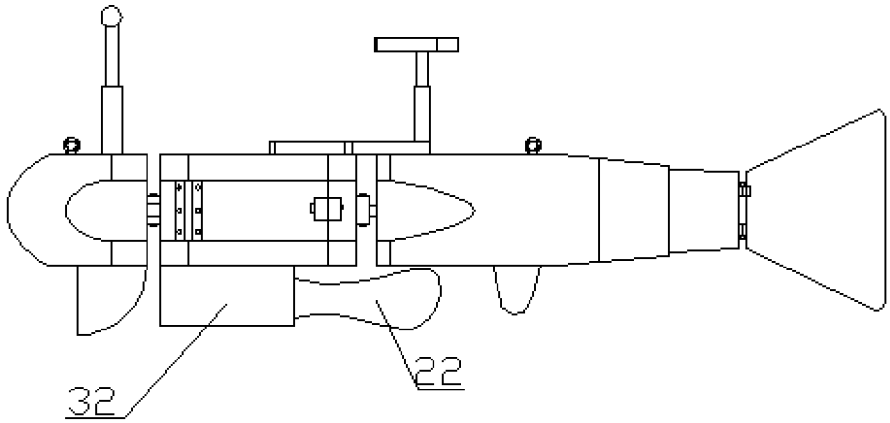
FIG. 5 is a schematic structure diagram of an aquaplane according to Embodiment 4 of the present disclosure.
Figure 9:
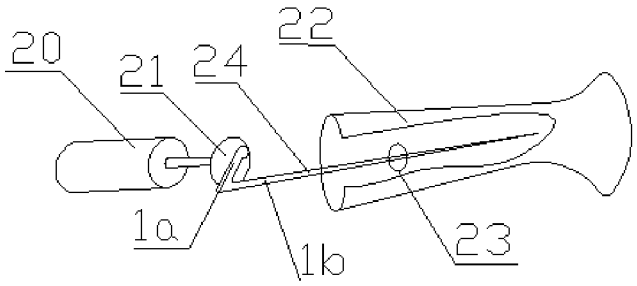
FIG. 9 is a schematic structure diagram of a swing mechanism according to Embodiments 4 and 7 of the present disclosure.

As illustrated in FIGS. 5 and 9, an electric propulsion device comprising a waterproof container 32, a motor 20, a battery (not illustrated), a control lever (not illustrated) and a swing mechanism is mounted below the aquaplane described in Embodiment 2. The motor 20 and the battery are mounted in the waterproof container 32, and a swing mechanism is connected behind the motor 20. As illustrated in FIG. 9, the swing mechanism comprises a swing wheel 21, a connecting rod 24, and a fishtail part 22, wherein the fishtail part 22 has a hollow structure with an oval hollow cross-section, and a fixing ring 23 is mounted therein. A center of the swing wheel 21 is connected with a motor shaft and driven to rotate by the motor 20. The connecting rod 24 is L-shaped and comprises a short side 1*a* and a long side 1*b*, which form an acute angle with each other. The short side 1*a* is mounted on the swing wheel 21 along a diameter of the motor shaft. The long side 1*b* penetrates through the fixing ring 23 into the fishtail part 22. When the motor 20 is started, the swing wheel 21 drives the connecting rod 24 to rotate, the connecting rod 24 rotates in the fishtail part 22 through the fixing ring 23, and a tail end track of the connecting rod 24 is circular. Since the hollow cross-section of the fishtail part 22 is oval, and a short side of the oval is designed to be smaller than a diameter of a circle formed by the tail end track of the connecting rod 24, the fishtail part 22 will swing left and right under the drive of the connecting rod 24. The control lever is mounted on the handle 2 to control the start and stop of the motor 20. The battery supplies power to the motor 20, the motor 20 drives the swing mechanism, and the swing mechanism drives the fishtail part 22 to swing forward. The device can reduce the burden of manual riding on water and improve the speed and comfort.

Embodiment 5

Figure 6:
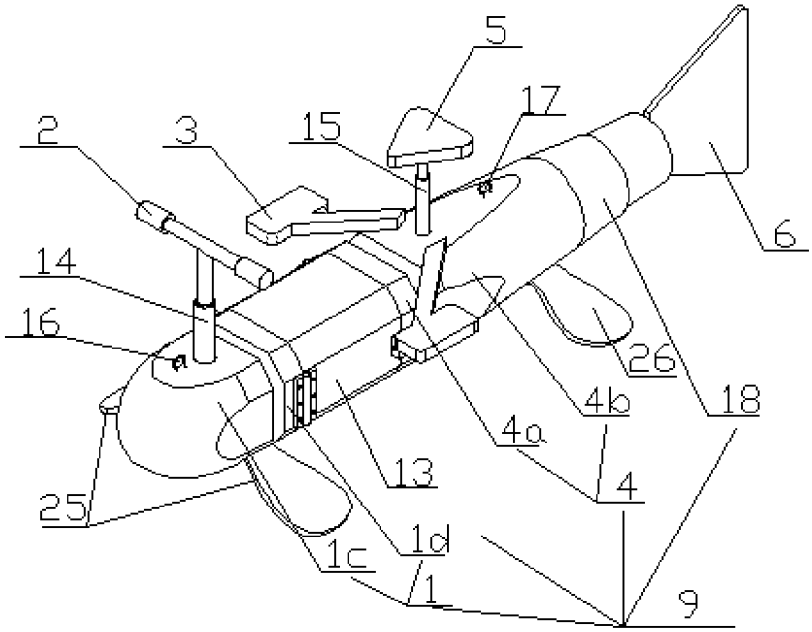
FIG. 6 is a schematic structure diagram of an aquaplane according to Embodiment 5 of the present disclosure.

As illustrated in FIG. 6, the aquaplane of the present disclosure comprises a buoyancy device 9, a handle 2, foot pedals 3 and a seat cushion 5. The buoyancy device 9 comprises a head buoyancy component 1, a body buoyancy component 13, a rear fixing bracket assembly 4 and a tail buoyancy part 18.

The head buoyant part 1 comprises a first head buoyant member 1*c* and a second head buoyant member 1*d*, which are in hinge connection and can rotate around a vertical axis within an angle. The second head buoyancy member 1*d* and the body buoyancy component 13 are in hinge connection on one side, and in bolt connection on the other side. In use, the bolts are connected with each other, and when folding is needed, the bolts are loosened for folding. Front drive parts 25, preferably hard blades, are symmetrically mounted on left and right sides below the first head buoyancy member 1*c*.

The rear fixing bracket assembly 4 comprises a first rear fixing bracket 4*a* and a second rear fixing bracket 4*b*, which are in hinge connection and can rotate around a vertical axis within an angle. The first rear fixing bracket 4*a* and the body buoyancy component 13 are in foldable connection, with one side in hinge connection and the other side in bolt connection. In use, the bolts are connected with each other, and when folding is needed, the bolts are loosened for folding. The second rear fixing bracket 4*b* is connected with the rear buoyancy part 18, while rear driving parts 26, preferably hard blades, are symmetrically mounted on left and right sides therebelow.

The tail buoyancy part 18 is a telescopic structure, and preferably composed of a plurality of hollow drums from large to small, wherein a smaller drum can be retracted into a larger drum. The tail buoyancy part 18 can be pulled out when in use and compressed when not in use.

A tail fin 6 may be foldably connected behind the tail buoyancy part 18, with one side in hinge connection with the tail buoyancy part 18, and the other side in bolt connection with the tail buoyancy part 18. In use, the bolts are tightly screwed for mutual connection, and when folding is needed, the bolts are loosened for folding. The shape of the tail fin 6 is preferably an upright fan-shaped fishtail.

The handle 2 is connected with the first head buoyancy member 1*c* through a telescopic rod 14; the seat cushion 5 is mounted on the second rear fixing bracket 4*b* through a telescopic rod 15; and a person can choose a sitting posture of riding on water or a standing posture of riding on water by adjusting heights of the handle 2 and the seat cushion 5.

A first hook 16 is disposed in front of the first head buoyancy member 1*c*, and a second hook 17 is disposed behind the second rear fixing bracket 4*b*. A plurality of aquaplanes may be connected through ropes or connecting rods and the like, so that a plurality of persons can ride on water at the same time, and the interest is increased.

The foot pedal 3 is fixedly connected with the second rear fixing bracket 4*b* through a connecting rod that can increase the moment arm when a person steps on the foot pedal, thereby saving more labor.

In use, a person steps on the left foot pedal to bend and twist the second rear fixing bracket 4*b* downwards in a left front direction, to insert the left rear driving part 26 into water and/or silt downwards in a left front direction; at the same time, the person can turn the handle downwards in a left rear direction, to bend and twist the first head buoyancy member 1*c*, and a front driving part 25 mounted on an upper left portion of the first head buoyancy member 1*c* will stir water and/or silt downwards in a left rear direction; similarly, when a person steps on the right foot pedal downwards in a right front direction, the left rear driving part 26 will stir water and/or silt backwards, and the right rear driving part 26 will be inserted into water and/or silt downwards in a right front direction; at the same time, the person can rotate the handle downwards in a right rear direction, so that the right front driving part 25 stirs water and/or silt. In this process, the tail fin 6 will be forced to swing left and right, thereby stirring water and/or silt. By repeating the process, the aquaplane can advance in both water and silt in a twisting and crawling manner simulating animals such as crocodiles.

A first hook 16 is disposed in front of the first head buoyancy member 1*c*, and a second hook 17 is disposed behind the second rear fixing bracket 4*b*. A plurality of aquaplanes may be connected through ropes or connecting rods and the like, so that a plurality of persons can ski at the same time, and the interest is increased.

Embodiment 6

Figure 7:
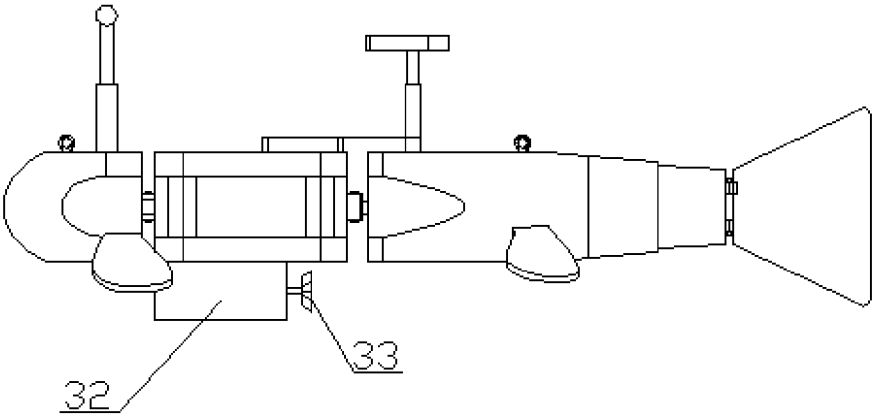
FIG. 7 is a schematic structure diagram of an aquaplane according to Embodiment 6 of the present disclosure.

As illustrated in FIG. 7, an electric propulsion device comprising a waterproof container 32, a motor (not illustrated), a battery (not illustrated), a control lever (not illustrated) and a propeller 33 is mounted below the aquaplane described in Embodiment 5. The motor 20 and the battery are mounted in the waterproof container 32, the control lever is mounted on the handle 2, and the propeller 33 is connected with a motor shaft. The battery supplies power to the motor 20, the control lever controls the start and stop of the motor 20, and the motor 20 drives the propeller 33 to rotate, thereby generating a forward driving force. The device can reduce the burden of manual skiing and improve the speed and comfort.

Embodiment 7

Figure 8:
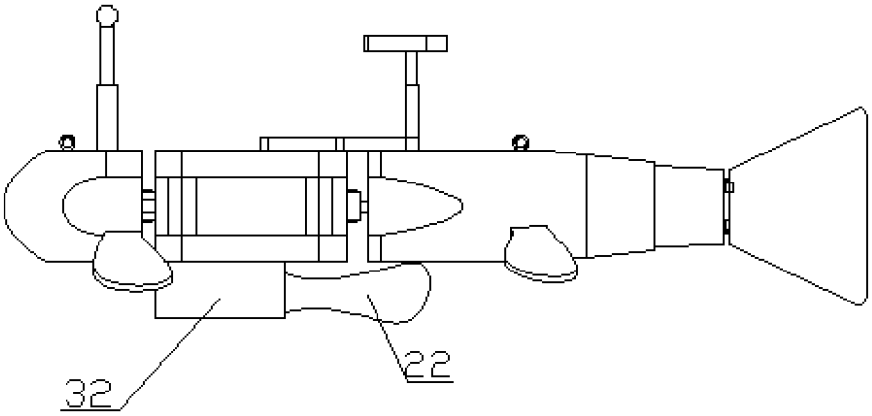
FIG. 8 is a schematic structure diagram of an aquaplane according to Embodiment 7 of the present disclosure.

As illustrated in FIGS. 8 and 9, an electric propulsion device comprising a waterproof container 32, a motor 20, a battery (not illustrated), a control lever (not illustrated) and a swing mechanism is mounted below the aquaplane described in Embodiment 5. The motor 20 and the battery are mounted in the waterproof container 32, and a swing mechanism is connected behind the motor 20. As illustrated in FIG. 9, the swing mechanism comprises a swing wheel 21, a connecting rod 24, and a fishtail part 22, wherein the fishtail part 22 is a hollow structure with an oval hollow cross-section, and a fixing ring 23 is mounted therein. A center of the swing wheel 21 is connected with a motor shaft and driven to rotate by the motor 20. The connecting rod 24 is 7-shaped and comprises a short side 1*a* and a long side 1*b*, which form an acute angle with each other. The short side 1*a* is mounted on the swing wheel 21 along a diameter of the motor shaft. The long side 1*b* penetrates through the fixing ring 23 into the fishtail part 22. When the motor 20 is started, the swing wheel 21 drives the connecting rod 24 to rotate, the connecting rod 24 rotates in the fishtail part 22 through the fixing ring 23, and a tail end track of the connecting rod 24 is circular. Since the hollow cross-section of the fishtail part 22 is oval, and a short side of the oval is designed to be smaller than a diameter of a circle formed by the tail end track of the connecting rod 24, the fishtail part 22 will swing left and right under the drive of the connecting rod 24. The control lever is mounted on the handle 2 to control the start and stop of the motor 20. The battery supplies power to the motor 20, the motor 20 drives the swing mechanism, and the swing mechanism drives the fishtail part 22 to swing forward. The device can reduce the burden of manual riding on water and improve the speed and comfort.

It should be noted that the above preferred embodiments are merely illustrative of the technical concept and characteristics of the present disclosure, and the purpose is to enable those skilled in the art to understand the content of the present disclosure and implement the same accordingly, while the protection scope of the present disclosure is not limited thereto. Any equivalent variation or modification made in accordance with the spirit essence of the present disclosure should fall within the protection scope of the present disclosure.

The invention claimed is:

1. A portable foldable aquaplane comprising a buoyancy device, wherein the portable foldable aquaplane further comprises a handle, pedals and a seat cushion; and wherein the buoyancy device comprises a head buoyancy component and a body buoyancy component; the head buoyancy component comprises a first head buoyancy member and a second head buoyancy member which are swingably connected with each other; the second head buoyancy member is foldably connected with a front end of the body buoyancy component; the handle is connected with the first head buoyancy member through a first telescopic rod; and the seat cushion is connected with the body buoyancy component through a second telescopic rod.

2. The portable foldable aquaplane according to claim 1, wherein a lower side of the second head buoyancy member is connected with a lower side of the body buoyancy component through a first hinge, and an upper side of the second head buoyancy member is connected with an upper side of the body buoyancy component through a first bolt.

3. The portable foldable aquaplane according to claim 1, wherein the first head buoyancy member and the second head buoyancy member are connected with each other through a second hinge.

4. The portable foldable aquaplanes according to claim 1, wherein two sides of the body buoyancy component are symmetrically connected with side buoyancy members.

5. The portable foldable aquaplane according to claim 4, wherein the foot pedal is mounted on the side buoyancy member.

6. The portable foldable aquaplane according to claim 5, wherein the foot pedal is shaped to fit with a foot shape and is recessed into the side buoyancy member.

7. The portable foldable aquaplane according to claim 1, wherein the buoyancy device is made of a solid buoyancy material.

8. The portable foldable aquaplane according to claim 1, wherein a first hook is disposed in front of the first head buoyancy member, and a second hook is disposed behind the body buoyancy component.

* * * * *